United States Patent [19]

Perciful

[11] 4,042,488

[45] Aug. 16, 1977

[54] THERMAL CRACKING WAX TO NORMAL ALPHA-OLEFINS

[75] Inventor: Jerry C. Perciful, Groves, Tex.

[73] Assignee: Texaco Inc., New York, N.Y.

[21] Appl. No.: 625,351

[22] Filed: Oct. 23, 1975

Related U.S. Application Data

[63] Continuation-in-part of Ser. No. 411,550, Oct. 31, 1973, abandoned.

[51] Int. Cl.[2] ..... C07C 3/30; C10G 9/36

[52] U.S. Cl. ..... 208/102; 203/81; 208/130; 260/683 R

[58] Field of Search ..... 208/130; 260/683 R; 203/80, 81; 202/153

[56] References Cited

U.S. PATENT DOCUMENTS

| | | | |
|---|---|---|---|
| 2,172,228 | 9/1939 | Peski | 260/683 R |
| 2,736,685 | 2/1956 | Wilson et al. | 260/683 R |
| 2,945,076 | 7/1960 | Pardee | 260/683 R |
| 3,103,485 | 9/1963 | Cahn | 208/130 |

*Primary Examiner*—Herbert Levine
*Attorney, Agent, or Firm*—Thomas H. Whaley; Carl G. Ries; Carl G. Seutter

[57] ABSTRACT

Normal alpha-olefins containing minimum paraffin content are prepared from hydrocarbon wax streams by a process which comprises preheating a charge wax stock to thermal cracking temperature;

passing said charge wax stock during said preheating operation through the intermediate temperature range of 625°–800° F in a time less than about 8 seconds whereby the desired product contains a decreased proportion of paraffin impurities;

thermally cracking said preheated charge wax stock in vapor phase in the presence of steam at thermal cracking conditions thereby forming a product stream cracking effluent containing desired product n-alpha olefins containing 6–18 carbon atoms together with decreased proportion of paraffin impurities;

separating said desired product n-alpha olefins containing 6–18 carbon atoms from said product stream cracking effluent; and maintaining the Severity Value of said product stream cracking effluent during said separating less than about 66.5.

14 Claims, 1 Drawing Figure

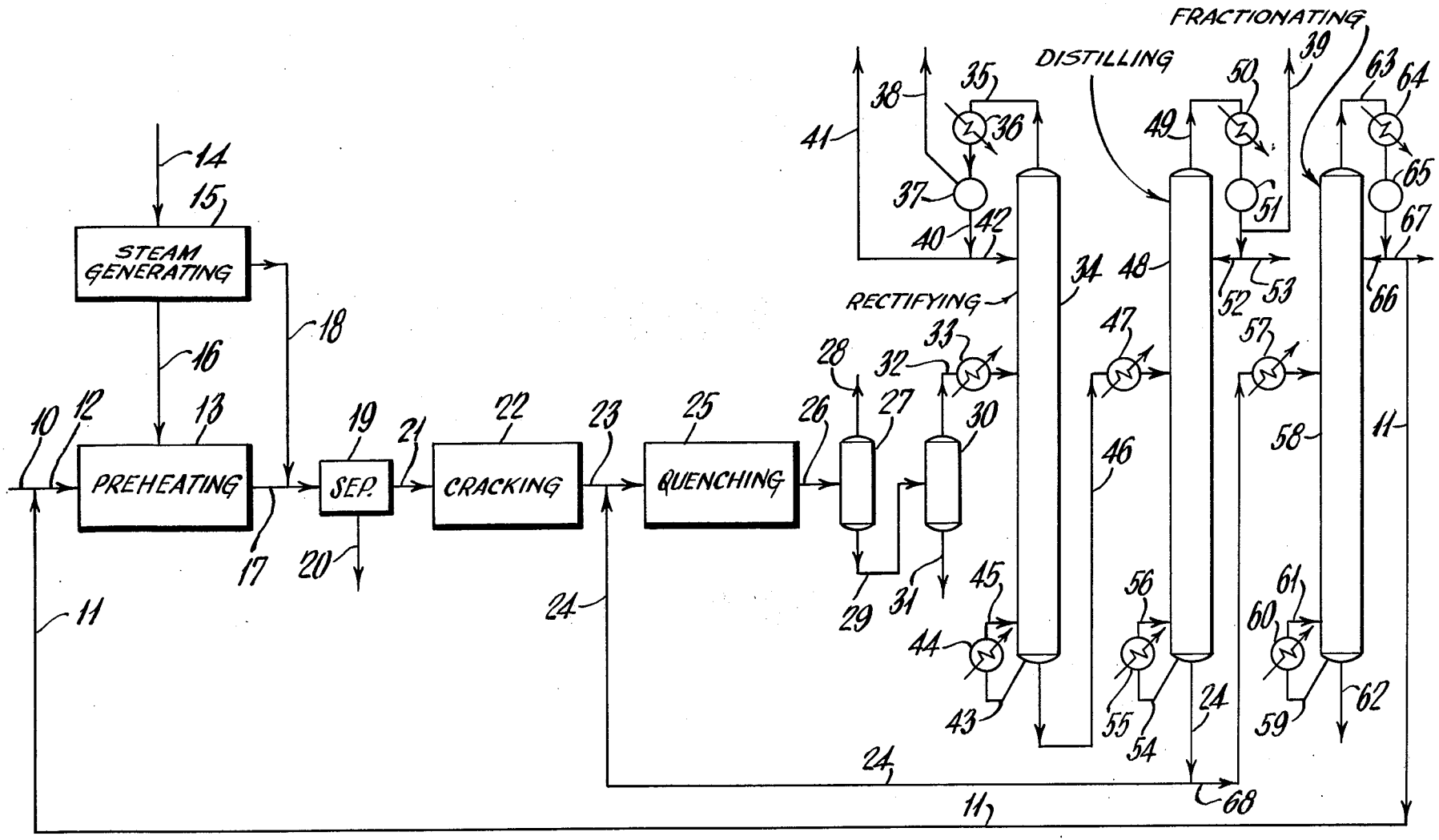
FRACTIONATING
DISTILLING
RECTIFYING
STEAM GENERATING
PREHEATING
SEP.
CRACKING
QUENCHING

THERMAL CRACKING WAX TO NORMAL ALPHA-OLEFINS

RELATED APPLICATION

This application is a continuation-in-part of application Ser. No. 411,550 filed Oct. 31, 1973 by Jerry C. Perciful, now abandoned.

FIELD OF THE INVENTION

This invention relates to the preparation of olefins. More particularly, it relates to the formation of olefins by the cracking of high boiling hydrocarbons.

BACKGROUND OF THE INVENTION

As is well known to those skilled in the art, olefins have heretofore have prepared by the thermal cracking of various hydrocarbon streams. The cracking operation may be conducted on a normally gaseous or normally liquid hydrocarbon charge; a common charge may be high boiling, normally liquid, hydrocarbon stream typified by a wax-containing stock.

In the thermal cracking of typical wax stocks at charge temperatures of 600° F-800° F, say 680° F-740° F, typically about 715° F and outlet temperatures of 1050° F-1250° F, say 1120° F,-1180° F, typically about 1125° F and outlet pressures of about 10-50 psig, say 15-40, typically about 20 psig, it is found that the product of effluent gas may contain an undesirably high content of paraffins in addition to the desired olefin content. Presence of paraffin represents decreased efficiency of the process.

It is an object of this invention to provide a process for cracking a charge high boiling hydrocarbon. It is another object of this invention to provide a process for cracking a charge high boiling hydrocarbon to form a product olefin characterized by decreased content of paraffins. Other objects will be apparent to those skilled in the art.

STATEMENT OF THE INVENTION

In accordance with certain of its aspects, the novel process of this invention n-alpha olefins containing 6-18 carbon atoms may comprise

- preheating a charge wax stock to thermal cracking temperature;
- passing said charge wax stock during said preheating operation through the intermediate temperature range of 625° F-800° F in a time less than about 8 seconds whereby the desired product contains a decreased proportion of paraffin impurities;
- thermally cracking said preheated charge wax stock in vapor phase in the presence of steam at thermal cracking conditions thereby forming a product stream cracking effluent containing desired product n-alpha olefins containing 6-18 carbon atoms together with decreased proportion of paraffin impurities;
- recovering said desired product n-alpha olefins containing 6-18 carbon atoms from said product stream cracking effluent; and
- maintaining the severity value of said product stream cracking effluent during said recovery less than about 66.5.

DETAILED DESCRIPTION OF THE INVENTION

The charge hydrocarbons which may be treated by the process of this invention may be high boiling hydrocarbons, typically having a boiling point of above about 600° F. More specifically the typical high boiling hydrocarbons may possess a 50% boiling point (as measured by ASTM Test D-1160 at 10mm. Hg absolute pressure) of 420° F-510° F, say 485° F.

The preferred charge hydrocarbons may be generally identified as petroleum waxes and may contain paraffinic hydrocarbons having at least about 18 carbon atoms. In a preferred embodiment, the hydrocarbon charge may contain 18-36 carbon atoms with typically less than about 0.1% of $C_{18}$ and lighter and less than about 2.5% heavier than $C_{36}$ Suitable feed stocks for wax cracking include those obtained from dewaxing operations. A wax recovered by urea-dewaxing of a paraffin-base vacuum gas oil is a suitable feed.

The fresh charge wax stock may typically have the following illustrative properties:

TABLE

| Property | Range | Preferred |
|---|---|---|
| Sp. Gr 60/60F | 0.81-0.85 | 0.81 |
| API Gravity | 35.6-44.2 | 43 |
| Melting Point ° F | 114-133 | 127 |
| Flash Point ° F (COC) | 360-490 | 420 |
| Kin Vis cs 210° F | 2.7-3.8 | 3.4 |
| 170° F | 4.4-5.2 | 5.1 |
| 150° F | 6.0-6.4 | 6.3 |
| Sulfur ppm | 0-750 | 5 |
| Pour Point ° F | 120+ | 120+ |
| Distillation ° F/10 mm Hg | | |
| IBP | 275-400 | 350 |
| 10% | 410-475 | 430 |
| 50% | 420-510 | 485 |
| 90% | 450-590 | 565 |
| $C_{18}$ % | less than 0.1-0.2 | less than 0.1 |

| Typically such a charge may contain: | |
|---|---|
| Content | Typical % |
| less than $C_{18}$ | 0.1 |
| $C_{18}$-$C_{20}$ | 2.7 |
| $C_{21}$-$C_{30}$ | 83.9 |
| $C_{31}$-$C_{36}$ | 12.9 |
| greater than $C_{36}$ | 0.4 |
| Paraffins | greater than 95 % |
| Olefins | less than 1 % |

In practice of the process of this invention in accordance with a preferred embodiment, 10-55 parts say 32 parts of fresh charge wax stock may be mixed with 31-62 parts, say 55 parts of recycle wax. Typically the recycle wax contains $C_{20}$ and greater fractions (with less than about 1.5-2% of less than $C_{20}$). The recycle wax may be indentified as a $C_{20}$-$C_{35}$ fraction wherein 30-60%, say about 47% may be within the $C_{22}$-$C_{25}$ region.

The combined fresh charge wax stock and recycle wax stock (typically mixed in ratio of 0.25:1-1.0:1, say 0.58) may contain 88-100%, say 92% paraffins, and less than 12%, say 6-10%, typically about 8% olefins.

66-95 parts, preferably 71-91 parts, say 87 parts of total charge, containing fresh and recycle stock are passed to a wax peheating operation to which the combined charge is admitted at 200° F-400° F, say 280° F at a space velocity LHSV of 5.3-21, say 8.5. There is also admitted with the wax charge, steam in amount of 5-34 parts, say 13 parts (preferably 10%-41%, say 15% of the wax charge) at a temperature of 300° F–400° F, say 350° F and pressure of 40–100 psig, say 55 psig.

Preheating is carried out in the presence of steam to volatilize at least about 80 mole % of the wax charge, typicaly 80–100 mole %, say 90 mole %. The wax preheater outlet is at a temperature of 600° F–800° F, preferably 690° F–750° F, say 725° F 30–100 psig, preferably 40–60 psig, say 50 psig.

It is a particular feature of the process of this invention that the preheating (including vaporization) operation be carried out with a LHSV (based on inlet conditions) of 5.7–14, preferably 7.1–14, say 9.5 which permits the wax charge to pass through the intermediate temperature range of 625° F–800° F, in a time of less than about 8 seconds, preferably less than 5, typically 3–5 seconds, say about 4 seconds.

Preheating the wax charge under these conditions desirably reduces the content of undesired paraffin in the desired C-6 to C-18 portion of the ulitimate product n-alpha olefin to less than 4%, preferably 1–3%; if the wax charge be preheated at temperatures in or above this range for longer periods of time than those noted, the corresponding paraffin content may be above 5%, say 6–11%.

To the 66–95 parts, say 87 parts of preheated wax stock, at 600° F–800° F, preferably 690° F–750° F, say 725° F and 30–100 psig, preferably 40–60 psig, there are added 0–20 parts, preferably 2–12 parts, say 4 parts of steam. The preheated wax stock, now essentially completely vaporized is preferably passed through a separator wherein any non-vaporized material is separated; and the resulting vapor is passed to wax cracking.

The total time that the charge material has spent in processing, between admission to the preheating operation and admission to the thermal cracking operation, is controlled so that this material is within the 625° F–800° F, preferably 625° F–750° F, range for less than 8 seconds, preferably 3–5 seconds. Preheating alone (not including vaporization) will typically be effected in the noted temperature range for less than about 5 seconds, typically about 3 seconds.

Thermal cracking in vapor phase of the vaporized wax charge stock is efected by passing the mixture, containing 50–94 mole %, preferably 71–82 mole %, say 80 mole % steam to a thermal cracking operation at 600° F–800° F, preferably 680° F–740° F, say 715° F. The space velocity VHSV is controlled to be, based on inlet conditions, 510–2550 , preferably 970–1570, say 1200. After 0.8–4.0 seconds, preferably 1.3–2.1 seconds, say 1.7 seconds, the thermally cracked wax stream is withdrawn at 1050°–1250° F, preferably 1120°–1180° F, say 1125° F and 10–50 psig, preferably 15–40 psig, say 20 psig.

The charge wax stream which, as admitted to thermal cracking contains 88–100%, preferably 90–94%, say 92% paraffins and 6–10% olefins, is found after cracking to contain 40–82%, preferably 52–70%, say 64% paraffins and 17–55%, preferably 28–44%, say 33% olefins.

The cracking furnace effluent may typically contain the following parts by weight:

| Component | Preferred | Typical |
|---|---|---|
| $C_6$–$C_{18}$ total | 15–25 | 18 |
| n-alpha olefins | 13–21.9 | 16 |
| paraffins | 0.4–0.7 | 0.5 |
| $C_{19}$ and greater | 59–74 | 69 |

In the preferred embodiment, the high temperature thermal cracker total effluent in amount of 71–149 parts, preferably 82–132 parts, say 104 parts is quenches, by direct quenching, with a heavy quench stream. A preferred heavy quench stream is a portion of that recovered during subsequent operations containing uncoverted wax and heavy by-products. The quench stream, added in amount of 50–250 parts, preferably 75–200 parts, say 115 parts at 130° F –210° F, preferably 150° F–190° F, say 170° F typically is a liquid stream of hydrocarbons having 17–37 carbon atoms with predominating hydrocarbons having 21–31 carbon atoms.

The quench stream is preferably added to the cracked effluent in weight ratio of 48–240 parts, typically 72–192 parts, say 110 parts of quench stream per 100 parts of effluent.

The combined stream of effluent and quench medium from quenching at 565° F, –675° F, preferably 600° F–655° F, say 635° F is cooled to 130° F–300° F, preferably 135° F–200° F, say 140° F and passed to a gas-liquid separation operation wherein 4–13 parts, say 8 parts of gas are separated. The liquid is passed to an oil-water separator wherein 9–33 parts, say 14 parts of water are separated.

The separated hydrocarbon liquid in amount of 113–340 parts, preferably 142–287 parts, say 194 parts is heated to 130° F–200° F, preferably 140° F–180° F, say 150° F and passed to rectification operation to which it is admitted at 0–20 psig, preferably 0–10 psig, say 2 psig.

In the rectification operation, as practiced in a typical embodiment, overhead is withdrawn at 80° F–135° F, preferably 85° F–115° F, say 90° F. The rectified overhead is condensed against water to yield an overhead product containing 0–4 parts, preferably 1–3 parts, say 2 parts of uncondensible gases - mainly hydrocarbons including less than about 5 carbon atoms together with small amounts of hydrogen, carbon monoxide, and carbon dioxide.

The condensed portion is a hydrocarbon phase in amount of 3.3–11 parts, preferably 4.4–10 parts, say 8 parts - typically containing predominantly hydrocarbons having 4–5 carbon atoms. 3–10 parts, preferably 4–9 parts, say 7 parts of this hydrocarbon may be returned to the rectifying operation as reflux, the remainder being withdrawn as by-product.

Bottoms in the rectification operation are reboiled at 140° F–630° F, preferably 160° F–200° F, say 180° F. Net bottoms in amount of 113–336 parts, preferably 141–284 parts, say 194 parts are withdrawn at 140° F–220° F, preferably 160° F–200° F, say 180° F. Net bottoms containing some water, are predominantly hydrocarbons having 18–44 carbon atoms with the largest portion having 20–32 carbon atoms. The net bottoms contain 9 –30, preferably 15–24%, say 18n-alphaolefins and 69–90%, preferably 75–84%, say 81% n-paraffins.

Rectifier bottoms are heated to 490° F–610° F, preferably 520° F–580° F, say 550° F and passed to a distillation operation at 25–250, preferably 50–150, say 100mm Hg absolute pressure. In the distillation operation, an overhead product stream is produced at 300° F–420° F, preferably 330° F–390° F, say 360° F. The condensed portion includes 1–10 parts, preferably 2–8 parts, say 3 parts of an aqueous phase consisting essentially of water — this is separated and may be recycled eg to the stream generating operation. The condensed product also includes a hydrocarbon phase in amount of 54–180 parts, preferably 90–144 parts, say 108 parts. This overhead stream is condensed against water. 45–150 parts, preferably 75–120 parts, say 90 parts of condensate are returned as reflux to the distillation operation; and 9–30 parts, preferably 15–24 parts, say 18 parts are withdrawn as desired product n-alpha olefin.

The desired n-alpha olefine product may contain 76–83%, preferably 79–83%, say 80% olefins and 7–10%, preferably 7–9%, say 8% paraffins. The C-6 to C-18 portion of the desired n-alpha olefin product contains less than 4% preferably 1–3%, say 3% of paraffins. Lesser quantities of other hydrocarbons may be present. The product typically contains hydrocarbons having 5–23, preferably 6–18 carbon atoms; and in typical practice of the invention the liquid product may contain more-or-less equal portions of hydrocarbons having 6–18, preferably 19–23, carbon atoms. This fraction may readily be further separated if desired into several fractions containing eg (a) C-6 to C-10, (b) C-11 to C-14, and (c) C-15 to C-18, (not shown).

Bottoms from the distillation operation are reboiled at 575° F.–635° F., preferably 590° F–620° F, say 605° F. Net bottoms in amount of 82–317 parts, preferably 115–261 parts, say 173 parts are withdrawn at 575° F.–635° F. preferably 590° F–620° F., say 605° F. Net distillation bottoms contain hydrocarbons having 18–44 carbon atoms. This paraffinic stream may typically contain 80–94%, preferably 84–90%, say 88% paraffins and 6–20%, preferably 10–16%, say 12% of olefins.

50–250 parts, preferably 75–200 parts, say 115 parts of paraffinic distillation operation bottoms may be cooled to 130° F–210° F, preferably 150° F–190° F, say 170° F and passed to quenching — more specifically it is combined with and serves to quench the gaseous effluent from the cracking operation.

The remaining portion of the paraffinic distillation operation bottoms, 32–67 parts, preferably 40–61 parts, say 58 parts cools during transfer and pumping operations and is passed to a heating operation wherein it is heated to 525° F–595° F, preferably 540° F–570° F, say 555° F; and then it is passed to a fractionation operation at 1-6, preferably 2–5, say 4mm. Hg absolute pressure.

Bottoms from the fractionation operation are reboiled at 590° F–605° F, preferably 605° F–640° F, say 630° F and withdrawn at 590° F–605° F, preferably 605° 620° F in amount of 1–5 parts, preferably 2–4 parts, say 3 parts. These bottoms contain hydrocarbons having 24–44 carbon atoms.

Overhead from the fractionation operation, in amount of 62–124 parts, preferably 76–114 parts, say 110 parts is withdrawn at 445° F–505° F, preferably 460° F–480° F, say 475° F and 1–4, preferably 1–3, say 2mm. Hg and condensed against warm water. 31–62 parts, preferably 38–57 parts, say 55 parts are returned to the fractionation operation as pumped reflux; and 31–62 parts, preferably 38–57 parts, say 55 parts are passed as recycle wax to be mixed with the charge to the preheating operation.

It is a feature of the process of this invention that the desired n-alpha olefin product having 6–18 carbon atoms may be characterized by the presence of decreased quantities of paraffins. The paraffin content may be kept below 4% and typically 1–3%, say at about 2% if the following criteria are met during the processing:

i. the temperature of the charge (including recycle) wax during the preheating step prior to cracking should not be within the intermediate temperature range of 625° F–800° F for more than about 8 seconds; and ii. the severity value of the system, during the recovery of the desired product from the cracking effluent, should be less than about 66.5 — where the overall severity value (S.V.) is defined as:

$$SV = \ln t + 0.096T$$

wherein $t$ is the time in minutes that the liquid cracking effluent is at temperature at least as high as 610° F and $T$ is the time-weighted average temperature that the liquid cracking effluent is at a temperature at least as high as 610° F.

Control of the time-temperature relation during preheating — including the period from which the process stream is admitted to the preheating operation, the period in the preheating operation, the period in the several process vessels, conduits, etc. associated with the preheating operation, the period in the separation operation, etc. — desirably minimizes the content of paraffins in the ultimate product. Preferably the time spent at 625° F–800° F, typically 625° F–750° F should be less than about 8 seconds, preferably 3–5 seconds, say 4 seconds; and this may normally permit attainment of product containing less than 4% paraffins. Typical paraffin conent may be 1–3%; practice of control processes, otherwise comparable but not complying with the noted requirements, typically yields product containing 5% or more paraffin.

It is also a feature of the process of this invention that the temperature of the cracking effluent or the time at elevated temperature of the cracking effluent (in the process sequence following the actual cracking operation e.g. during rectification, distillation, and fractionation) should be controlled so that the overall severity value as defined supra is less than about 66.5. It will be apparent to those skilled in the art from the description of the process that the most severe conditions in this portion of the process are normally found in the reboiler (and column sump) portions of the several columns. The liquid in the stripping portion of a column and in the reboiler proper (and column sump) may typically be subjected to high temperatures for longer periods of time than elsewhere in the system because of the high temperatures required to effect reboiling of the bottoms liquid and also because the reboil ratio (essentially the LHSV in the reboiler) may normally be high. Thus limiting the time spent at the elevated temperatures is found to conduce the formation of decreased amounts of paraffins by cracking, etc.

It is found that the time-temperature relationship of those liquids which contain the desired olefin product, and preferably those which are recycled to the preheating step, should be controlled.

Specifically it is desired to conduct the rectification operation such that the total reboiler residence time — temperature relationship is characterized by a severity relationship wherein the bottoms is at temperature which is not above 610° -630° F for more than about 35 minutes. Typically the noted liquid may be maintained at 610° F–630° F for 20–35 minutes.

It will be apparent to those skilled in the art that the relationships noted herein are intended to characterized the severity of operation; and within reasonable limits, it is clearly possible to increase either the time or the temperature, if the other be decreased correspondingly.

The significant factor is that the severity of the operation should be less than a predetermined value.

In the case of the rectification bottoms, this Severity Value S.V. (calculated by multiplying 0.096 by the time-weighted average temperature $T$ (°F) (at temperature at least as high as 610° F) of the liquid passing through the relevant portion of the system and adding the resulting product to the natural logarithm of the number of minutes of residence time $t$, at temperature at least as high as 610° F, of the liquid in that portion of the system should be less than 64.0:

$$S.V. = \ln t = 0.096\ T$$

The distillation operation, from which the product n-alpha olefin is recovered as overhead, is characterized by a similar time-temperature relationship for the reboiler and column sump section. Specifically the bottoms should be maintained preferably at temperature which is not above about 610° F for more than about 200 minutes. Typcially the temperature of the reboiler portion of this distillation operation may be below 610° F, say 600°F–610° F for 130–190 minutes. However a temperature of over eg 640° F for more than 100 minutes is found to be unsatisfactory.

The Severity Value S.V. for the distillation operation should be less than 64.0

$$S.V. = \ln t + 0.096\ T$$

wherein $T$ is the time-weighted average temperature (°F) (at temperature at least as high as 610° F) of the liquid passing through the relevant portion of the system.

If it be desired to further fractionate the bottoms from the distillation operation in a fractionation operation and to recycle the overhead from the latter to the preheating operation — as is done in the preferred embodiment — it will be desirable to carry out the fractionation operation so that the bottom therein and therefrom should be maintained at temperature which preferably is not above about 630° F and which is at 610° F–630° F for less than about 240 minutes. Typically this relationship may be such that the temperature may be 560° F–630° F for 150–240 minutes. As the temperature or the time increases above this point (eg above 630° F or above 240 minutes) the content of paraffins in the product is increased.

The preferred Severity Value at the reboiler section of the fractionation operation may preferably be less than 66.0.

It has further been found that the overall time-temperature relationship in the separation section including preheaters, reboilers, column sumps, etc. must have an overall Severity Value of less than about 66.5 wherein the overall Severity value is defined as:

$S.V._{o/A}$ = ln (ΣResidence time at least as high as 610° F in all reboilers, preheaters, and column sumps, in minutes) + (0.096) (time-weighted average temperature at temperature at least as high as 610° F in all reboilers, preheaters and column sumps, °F)

Thus in summary, it is preferred to carry out the operations such that i. the temperature of the preheating and vaporization operations should be within the intermediate temperature range of 625° F–800° F for not more than about 8 seconds; and ii. the time and temperatures in the column preheaters, column reboilers, and column sumps of the post-cracking operations should be controlled to maintain the Severity Value at less than about 66.5.

To illustrate how an illustrative SV is calculated (eg that for the distillation operation) it is assumed that i. the column preheater inlet temperature is 180° F, the outlet temperature is 550° F and the total time that the liquid is in the distillation column preheater is 3 minutes;

ii. the sump temperature is 610° F and the total time in the sump is 5 minutes;

iii. the reboiler inlet temp is 610° F, and the total time in the reboiler is 1 minute.

Then the SV is calculated as follows: Because the liquid in the column preheater is never above 610° F, the contribution of the column preheater to the SV is zero. The time-weighted average temperature in the reboiler and in the column sump, with a linear temperature profile in the reboiler, would be $$T = \left[ \left( \frac{630 + 610}{2} \right) (1\ \text{min.}) + (610)\ (5\ \text{min.}) \right] \div 6\ \text{min.}$$

$$T = 611.7°\ F$$

The time at temperatures at least 610° F would be $$t = 1\ \text{min.} + 5\ \text{min.} = 6\ \text{min.}$$

Thus, $SV = \ln 6 + (0.096)\ (611.7) = 60.5.$

DESCRIPTION OF A PREFERRED EMBODIMENT

Practice of the process of this invention will be apparent to those skilled in the art from inspection of the following description of a preferred embodiment wherein, as elsewhere in this application, all parts are parts by weight unless otherwise specificed.

In a typical embodiment, as set forth in the schematic flow sheet of the drawing 32 parts of a fresh charge hydrocarbon at 280° F and 55 psig are admitted through line 10. The composition of this fresh charge wax stock is:

| Property | Value |
|---|---|
| Sp. Gr. 60/60F | 0.81 |
| API Gravity | 43 |
| Melting point ° F | 127 |
| Flash point ° F (COC) | 420 |
| Kin Vis cs 210° F | 3.4 |
| 170° F | 5.1 |
| 150° F | 6.3 |
| Sulfur ppm | 5 |
| Pour Point ° F | 120+ |
| Distillation ° F/10mm Hg | |
| IBP | 350 |
| 10% | 430 |
| 50% | 485 |
| 90% | 565 |
| less than C-18 | 0.1% |
| C-18 to C-20 | 2.7% |
| C-21 to C-30 | 83.9% |
| C-31 to C-36 | 12.9% |
| greater than C-36 | 0.4% |
| Paraffin Content | > 95% |
| Olefin Content | < 1% |

This fresh charge is mixed with 55 parts of recycle wax at 280° F from line 11 to form a total charge at 280° F and 55 psig in line 12 having the following properties:

| Property | Values |
|---|---|
| Sp. Gr. 60/60F | 0.81 |
| API Gravity | 43 |
| Melting point ° F | 122 |
| Flash point ° F (COC) | 390 |
| Kin Vis cs 210° F | 3.3 |
| 170° F | 4.8 |
| 150° F | 5.9 |
| Sulfur ppm | 6 |
| Pour Point ° F | 120+ |
| Distillation ° F/10mm Hg | |
| IBP | 307 |
| 10% | 428 |
| 50% | 470 |
| 90% | 560 |
| less than C-18 | 0.1 |
| C-18 to C-20 | 3.0 |
| C-21 to C-30 | 87.3 |
| C-31 to C-36 | 9.4 |
| greater than C-36% | 0.1 |
| Paraffin Content % | 92 |
| Olefin Content % | 8 |

87 parts of total stock in line 12 at 280° F are admitted to the preheating operation wherein they are contacted with steam as they pass through a fired heater. Water from line 14 is passed to steam generating operation 15 and 13 parts of steam at 350° F and 55 psig are passed through line 16 to preheating operation 13 wherein it assists in volatilizing the charge from line 12.

Preheated charge leaves preheating operation 13 through line 17 at 725° F and 50 psig. 90 mol % of the wax in the effluent is in gas phase. Effluent is mixed with 4 parts of steam from line 18 at 900° F and 50 psig which volatilizes essentially 100% of the effluent. The nonvolatilized liquids and solids are removed in separation operation 19 and withdrawn from the system through line 20. The gas at 715° F and 30 psig is withdrawn from the separation operation through line 21.

During the period in which the charge to preheating in line 12 is converted to vapor in line 21, the wax charge has passed through the intermediate temperature range of 625° F–800° F during a period of about 4 seconds. The VHSV in the preheating operation is about 900.

Thermal cracking in cracking operation 22 is effected in the presence of steam at outlet temperature of 1125° F and outlet pressure of 20 psig. The olefin content of effluent in line 23 is 33% and the paraffin content is 64%. The paraffin content of the $C_6$ to $C_{18}$ portion of the effluent in line 23 is less than 4%. (A control process wherein the preheating operation is carried out so that the charge is within the 625° F–800° F range for eg 11 seconds would typically have a paraffin content of 7–8%).

The high temperature thermal cracking effluent in line 23 is quenched by mixing therewith 115 parts of a quench stream in line 24 at 170° F. After quenching in quenching operation 25 the stream may optionally be further cooled (not shown) and passed through line 26 to separator 27. Volatiles, including steam and light hydrocarbons, are removed, as shown schematically, through line 28. The liquid is passed through line 29 to separator 30 from which water is withdrawn through line 31.

Withdrawn through line 32 in amount of 194 parts is the net cracked effluent product characterized by an olefin content of 19 % and a paraffin content of 80.

Liquid in line 32 is heated to 150 ° F in heat exchanger 33 and passed at 2 psig to rectification operation 34. Overhead therefrom is withdrawn through line 35, condensed in part at least in condenser 36, and collected in drum 37. Withdrawn from drum 37 are 2 parts of noncondensibles, removed through line 38, and 8 parts of hydrocarbon condensate withdrawn through line 40. 1 part of this condensate, containing hydrocarbons of less than 6 carbon atoms, are withdrawn through line 41 and 7 parts are returned as pumped reflux through line 42.

The bottoms stream in rectification operation 34 is withdrawn in line 43 at 180° F, reboiled in reboiler 44, and returned to column 34 at 190° F and 3 psig. Net bottoms at 180° F and 3 psig ae characterized by a paraffin content of 81% and an olefin content of 18%.

The net rectifying operation bottoms, in amount of 194 parts, are heated to 550° F. before being passed to distilling operation 48 at 100 mm. Hg. The total time during which the bottoms from rectifying operation 34 are at temperatures of 140° -630° F is less than 35 minutes. The total time spent in line 46, in heat exchanger 47, in reboiler 44, and in the liquid sump of column 34 may be taken as the pertinent time; and in this embodiment, the liquid is within the range of 140° F–550° F for 35 minutes.

Charge to distillation operation 48 is distilled to yield 111 parts of overhead withdrawn at 360° F and 95 mm Hg through line 49. Condensation occurs in condenser 50 and the condensate is collected in drum 51. 3 parts of water are shown to be withdrawn through line 39. 90 parts of condensed hydrocarbons pumped reflux are passed through line 52; and there are recovered, through line 53, 18 parts of desired n-alpha olefin product containing predominantly hydrocarbons having 6 –20 carbon atoms; and this product contains less than 3 % paraffins. More particularly, the net olefin product is characterized as follows:

| Property | Values |
|---|---|
| Sp. Gr. 60/60F | 0.76 |
| API Gravity | 55 |
| Flash point ° F (TCC) | less than 70 |
| C-6 to C-10 | 33.5% |
| C-11 to C-14 | 23.1% |
| C-15 to C-18 | 21.0% |
| Greater than C-18 | 22.4% |
| Paraffin Content of C-6 to C-18 | 2.8% |
| n-alpha olefin content | 85.% |

The bottoms in distillation operation 48 are reboiled in reboiler circuit including line 54, reboiler 55, and return line 56. The reboiled liquid in line 56 is at 630° F and 110 mm. Hg. The composition of the bottoms in line 24 is:

| Property | Values |
|---|---|
| Sp. Gr. 60/60F | 0.81 |
| API Gravity | 43 |
| Melting Point ° F | 126 |
| Flash Point ° F (COC) | 400 |
| Kin Vis cs 210° F | 3.5 |
| 170° F | 5.0 |
| 150° F | 6.2 |
| Sulfur ppm | 6 |
| Pour point ° F | 120+ |
| Distillation | |
| IBP | — |
| 10% | 428 |
| 50% | 469 |
| 90% | 563 |
| Less than C-18 | less than 0.1% |
| C-18 to C-20 | 3.1% |
| C-21 to C-30 | 88.5% |
| C-31 to C-36 | 8.3% |
| greater than C-36 | 0.1% |
| Parafin Content | 88% |
| Olefin Content | 12% |

-continued

| Property | Values |
|---|---|
| Aromatic Content | |

The net distillation operation bottoms, during passage through the lower portion of the distillation tower and through the reboiling operation, are maintained in the range of 600° F–630° F for about 190 minutes, and are in the range of 610° F–630° F for 100 minutes with the time-weighted average temperature in this range of 615° F.

Of the total of 173 parts of net distillation bottoms, 115 parts are withdrawn through line 24 and, preferably after cooling to 170° F, are returned to quenching operation 25. 58 parts of this net distillation bottoms are withdrawn from line 24 through line 68 at 605° F. Heat losses are incurred in transferring this stream. Therefore it is heated in heat exchanger 57 to 555° F. The so heated stream is admitted at 4 mm. Hg to fractionation operation 58.

Bottoms in fractionation operation 58 at 620° F are reboiled in circuit including line 59, reboiler 60, and return line 61. The reboiled liquid in line 61 is at 630° F. Bottoms are withdrawn in amount of 3 parts from fractionation operation through line 62 at 620° F and 8 mm. Hg. The composition of the net bottoms in line 62 is:

| Property | Values |
|---|---|
| Sp. Gr. 60/60F | 0.84 |
| API Gravity | 37 |
| Flash point ° F (COC) | 520 |
| Kin Vis cs 210° F | 9.0 |
| 170° F | 14.5 |
| 150° F | 19.3 |
| Pour Point ° F | 120+ |
| Less than C-18 | None |
| C-18 to C-20 | less than 0.1% |
| C-21 to C-30 | 26.4% |
| C-31 to C-36 | 48.5% |
| greater than C-36 | 25.1% |

In this preferred embodiment, the net fractionation bottoms, during passage through the lower portion of the fractionation operation and through the reboiling operation, are maintained in the range of 620° F–630° F for about 200 minutes and the time-weighted average temperature during this period is 621° . It should be noted that this criterion is important when the net overhead is to be recycled to charge as is done in this preferred embodiment.

Overhead at 475° F and 2mm. Hg, withdrawn from fractionating operation 58 through line 63 is amount of 110 parts, has the following composition:

| Property | Values |
|---|---|
| Sp. Gr. 60/60F | 0.81 |
| API Gravity | 43 |
| Melting Point ° F | 120 |
| Flash Point ° F (COC) | 405 |
| Kin Vis cs 210° F | 3.5 |
| 170° F | 4.4 |
| 150° F | 5.5 |
| Sulfur ppm | 5 |
| Pour Point ° F | 120+ |
| Distillation ° F/10mm | |
| 10% | 428 |
| 50% | 464 |
| 90% | 532 |
| Less than C-18 | None |
| C-18 to C-20 | 3.0% |
| C-21 to C-30 | 86.9% |
| C-31 to C-36 | 8.6% |
| greater than C-36 | 1.5% |
| Paraffin Content | 88% |

-continued

| Property | Values |
|---|---|
| Olefin Content | 12% |

This stream is condensed in condenser 64 and collected in vessel 65. 55 Parts are returned as pumped reflux to fractionating operation 58 through line 66 and 55 parts are withdrawn through line 67. 55 parts are passed through line 11 to be recycled to the preheating operation 13 through line 12.

It will be noted that practice of the process of this invention permits efficient and economical conversion of 100 parts of fresh charge in line 10 to produce in line 53, 43 parts of product $C_6$–$C_{18}$ n-alpha olefins characterized particularly by the presence of less than about 4% paraffins.

In this embodiment, the SV in the rectifying operation is zero, the SV in the distilling operation is 63.6, and the SV in the fractionating operation is 64.9. The overall SV is 65.1 for these three operations. The time spent in the preheating operation at 625°–800° F is about 4 seconds.

Although this invention has been illustrated by reference to specific embodiments, it will be apparent to those skilled in the art that various changes and modifications may be made which clearly fall within the scope of this invention.

I claim:

1. The method of preparing n-alpha olefins containing 6-18 carbon atoms which comprises preheating and vaporizing a charge hydrocarbon wax stock to thermal cracking temperature;

passing said charge hydrocarbon wax stock during said preheating and vaporizing operation through the intermediate temperature range of 625° F–800° F in a time less than about 8 seconds whereby the desired product contains a decreased porportion of paraffin impurities;

thermally cracking said preheated charge wax stock in vapor phase at inlet temperatue of 600° F–800° F in the presence of steam at thermal cracking conditions thereby forming a product stream cracking effluent containing desired product n-alpha olefins containing 6–18 carbon atoms together with decreased proportion of paraffin impurities;

withdrawing said product stream cracking effluent at 1050° F–1250° F;

separating said desired product n-alpha olefins containing 6–18 carbon atoms from said product stream cracking effluent; and maintaining the Severity Value of said product stream cracking effluent during said separating less than about 66.5.

2. The method of preparing n-alpha olefins containing 6–18 carbon atoms as claimed in claim 1 wherein said charge hydrocarbon wax stock is passed through the intermediate temperature range of 625° F–800° F in 3–5 seconds.

3. The method of preparing n-alpha olefins containing 6–18 carbon atoms as claimed in claim 1 wherein said charge hydrocarbon wax stock is passed through the intermediate temperature of 625° F–750° F in 3–5 seconds.

4. The method of preparing n-alpha olefins containing 6–18 carbon atoms which comprises preheating and vaporizing a charge hydrocarbon wax stock to thermal cracking temperature;

passing said charge wax stock during said preheating and vaporizing operation through the intermediate temperature range of 625° F–800° F in time less than about 8 seconds whereby the desired product contains a decreased proportion of paraffin impurities;

thermally cracking said preheated charge wax stock in vapor phase, at inlet temperature of 600° F–800° F in the presence of steam at thermal cracking conditions thereby forming a product stream containing desired product n-alpha olefins containing 6–18 carbon atoms together with decreased proportion of paraffin impurities;

withdrawing said product stream cracking effluent at 1050° F–1250° F;

rectifying the thermally cracked wax stock thereby forming a n-alpha olefin containing rectified bottoms containing hydrocarbons having more than about 6 carbon atoms;

distilling said n-alpha olefin containing rectified bottoms thereby forming as overhead, product n-alpha olefin stream containing hydrocarbons having 6–18 carbon atoms; and maintaining the overall Severity Value of said rectifying operation and said distilling operation less than about 66.5.

5. The method of preparing n-alpha olefins containing 6–18 carbon atoms as claimed in claim 4 wherein the time in said preheating operation, not including vaporization, is less than about 3 seconds.

6. The method of preparing n-alpha olefins containing 6–18 carbon atoms as claimed in claim 4 wherein the Severity Value in the column preheater, column sump, and column reboiler portions of the rectifying operation is less than about 64.

7. The method of preparing n-alpha olefins containing 6–18 carbon atoms as claimed in claim 4 wherein the overall Severity Value in the column preheater, column sump, and column reboiler portions of the distillation operation is less than about 64.

8. The method of preparing n-alpha olefins containing 6–18 carbon atoms as claimed in claim 4 wherein a portion of the bottoms from the distilling operation is passed as quench liquid to the effluent from thermal cracking operation.

9. The method of preparing n-alpha olefins containing 6–18 carbon atoms which comprises preheating and vaporizing a charge hydrocarbon wax stock to thermal cracking temperature;

passing said charge wax stock during said preheating operation through the intermediate temperature range of 625° F–800° F in time less than about 5 seconds whereby the desired product contains a decreased proportion of paraffin impurities;

thermally cracking said preheated charge wax stock in vapor phase, at inlet temperature of 600° F–800° F, in the presence of steam at thermal cracking conditions thereby forming a product stream containing desired product n-alpha olefins containing 6–18 carbon atoms together with decreased proportion of paraffin impurities;

withdrawing said product stream cracking effluent at 1050° F–1250° F;

rectifying the thermally cracked wax stock thereby forming a n-alpha olefin containing rectified bottoms containing hydrocarbons having more than about 6 carbon atoms;

distilling said n-alpha olefin containing rectified bottoms thereby forming (i) as overhead a product n-alpha olefin stream containing hydrocarbons having 6–18 carbon atoms and (ii) as bottoms a stream containing hydrocarbons having more than about 20 carbon atoms;

passing a portion of said distilling operation bottoms as quench liquid to the effluent of said cracking operation;

fractionating a portion of said distilling operation bottoms thereby forming as overhead a wax condensate;

recycling at least a portion of said wax condensate to the charge to said preheating operation; and maintaining the overall Severity Value in the column preheater, column sump, and column reboiler portions of said rectifying operation, said distilling operation and said fractionating operation less than about 66.5.

10. The method of preparing n-alpha olefins containing 6–18 carbon atoms as claimed in claim 9 wherein the Severity Value in said rectifying operation is less than about 64.

11. The method of preparing n-alpha olefins containing 6–18 carbon atoms as claimed in claim 9 wherein the Severity Value in said distilling operation is less than about 64.

12. The method of preparing n-alpha olefins containing 6–18 carbon atoms as claimed in claim 9 wherein the Severity Value in said fractionation operation is less than 66.

13. In the method of preparing n-alpha olefins containing 6–18 carbon atoms including the steps of preheating and vaporizing a charge hydrocarbon wax stock to thermal cracking temperature;

thermally cracking said preheated charge wax stock in vapor phase at inlet temperature of 600° F–800° F in the presence of steam at thermal cracking conditions thereby forming a product stream cracking effluent containing desired product n-alpha olefins containing 6–18 carbon atoms;

withdrawing said product stream cracking effluent at 1050° F–1250° F; and separating said desired product n-alpha olefins containing 6–18 carbon atoms from said product stream cracking effluent; the improvement which comprises passing said charge wax stock during said preheating and vaporizing operation through the intermediate temperature range of 625° F–800° in a time less than about 8 seconds; and maintaining the Severity Value of said product stream cracking effluent during said separating less than about 66.5.

14. The method of preparing n-alpha olefins containing 6–18 carbon atoms as claimed in claim 13 wherein said charge hydrocarbon wax stock is passed through said intermediate temperature range of 625° F–800° F for 3–8 seconds.

* * * * *

UNITED STATES PATENT AND TRADEMARK OFFICE

CERTIFICATE OF CORRECTION

PATENT NO. : 4,042,488
DATED : August 16, 1977
INVENTOR(S) : JERRY C. PERCIFUL

It is certified that error appears in the above-identified patent and that said Letters Patent are hereby corrected as shown below:

Col. 1, line 19, cancel "have", second occurrence, insert --been--;

Col. 2, line 60, "0.58" should be --0.58:1--;

Col. 3, line 14, after "625°F-800°F," insert --preferably 625°F-750°F,--; line 19, correct the spelling of "ultimate"; line 44, cancel "82' mole", insert --92 mol--;

col. 4, line 3, cancel "quenches", insert --quenched--; line 28, before "rectification", insert --a--; line 55, cancel "18n", insert --18% n--;

Col. 5, line 44, change "590°F-605°F" to --590°F-650°F--; change "605°620°F" to --605°F-635°F, say 620°F--;

Col. 6, line 6, in the formula, correct "1n t" to read --ln t--; line 27, correct the spelling of "content";

Col. 7, line 12 and line 26 in the formulae, correct "1n t" to read --ln t--; line 39, correct the spelling of "bottoms"; line 56, correct "1n" to read --ln--;

UNITED STATES PATENT AND TRADEMARK OFFICE

CERTIFICATE OF CORRECTION

PATENT NO. : 4,042,488

DATED : August 16, 1977

INVENTOR(S) : JERRY C. PERCIFUL

It is certified that error appears in the above-identified patent and that said Letters Patent are hereby corrected as shown below:

Col. 8, line 29, correct "ln" to read --ln--; line 11, after "610°F," insert --the reboiler outlet temperature is 630°F--;

col. 9, line 64, cancel "80", insert --80%--.

Signed and Sealed this

First Day of August 1978

[SEAL]

*Attest:*

RUTH C. MASON
*Attesting Officer*

DONALD W. BANNER
*Commissioner of Patents and Trademarks*